United States Patent [19]

May

[11] Patent Number: 5,058,269

[45] Date of Patent: Oct. 22, 1991

[54] METHOD OF FORMING RECTANGULAR METAL TUBES

[75] Inventor: Robert A. May, Beeville, Tex.

[73] Assignee: May Fabricating Company, Inc., Houston, Tex.

[21] Appl. No.: 575,555

[22] Filed: Aug. 30, 1990

[51] Int. Cl.[5] ..... B23P 17/00

[52] U.S. Cl. ..... 29/897.35; 29/897.3; 29/897.312

[58] Field of Search ..... 29/897.3, 897.31, 897.312, 29/897.32, 897.33, 897.34, 89.35

[56] References Cited

U.S. PATENT DOCUMENTS

| | | | |
|---|---|---|---|
| 2,023,638 | 12/1935 | Lawson | 29/897.3 X |
| 2,085,829 | 7/1937 | Rogers | 29/897.35 |
| 2,115,441 | 4/1938 | Black | 29/897.35 X |
| 3,094,197 | 6/1963 | Attwood | 29/897.312 X |
| 3,232,259 | 2/1966 | Arrighini | 29/897.3 X |
| 4,216,895 | 8/1980 | Holmes | 29/897.35 X |

FOREIGN PATENT DOCUMENTS

| | | | |
|---|---|---|---|
| 3012238 | 10/1980 | Fed. Rep. of Germany | 29/897.3 |
| 2472072 | 6/1981 | France | 29/897.31 |

*Primary Examiner*—Timothy V. Eley
*Assistant Examiner*—C. Richard Martin
*Attorney, Agent, or Firm*—Vaden, Eickenroht, Thompson & Boulware

[57] ABSTRACT

There are disclosed alternative methods of and apparatus for use in forming a rectangular metal tube having openings in at least one side from a flat metal sheet which has generally laterally aligned slots in its opposite longitudinal edges of a size and shape to form the openings when opposite one another and which is bent into a shape having longitudinally extending, inwardly turned flanges along its longitudinally extending edges. The bent sheet is arranged with an intermediate, longitudinally extending mid-portion between a longitudinally extending die and one face of an elongate punch and with its slots on opposite lateral sides of rams of the press on the opposite face of the punch, the rams being of a size to fit within the openings, whereby the rans may be moved in a direction to force one side of the die against the strip in order to swing the sides of the sheet and the longitudinal edges of the flanges inwardly toward one another to cause the slots to form the openings on opposite sides of the rams.

4 Claims, 3 Drawing Sheets

FIG. 3
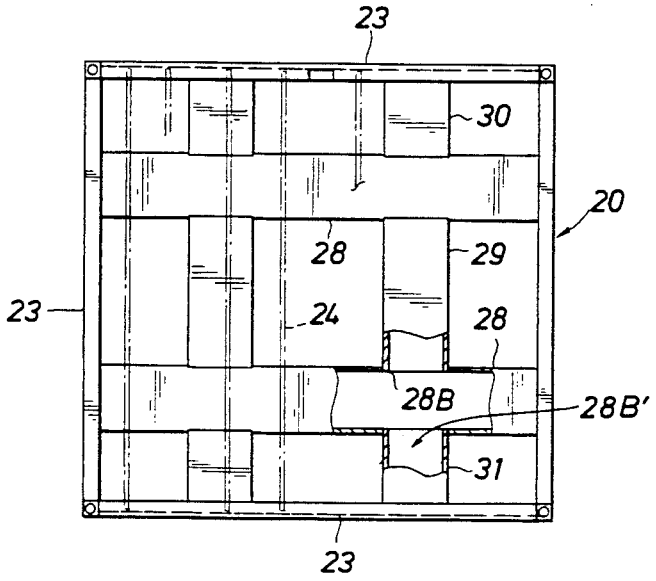
FIG. 12
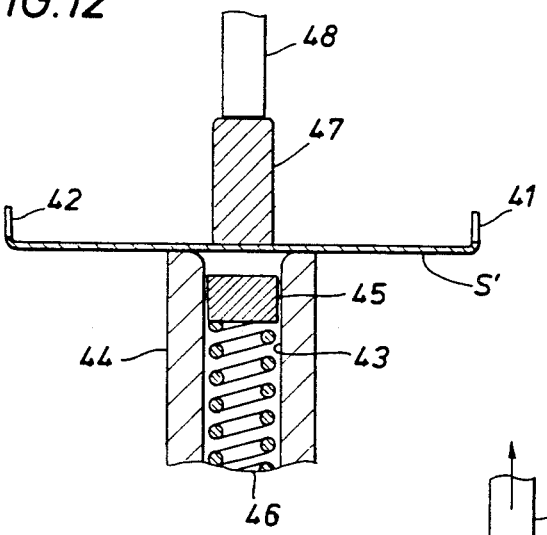
FIG. 13
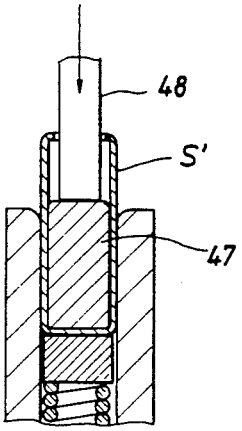
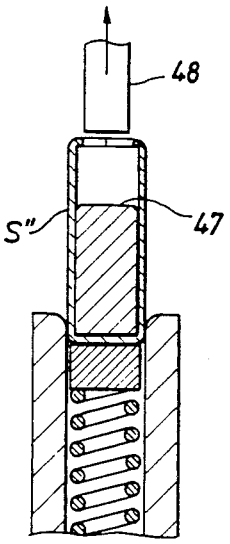
FIG. 14

FIG. 4
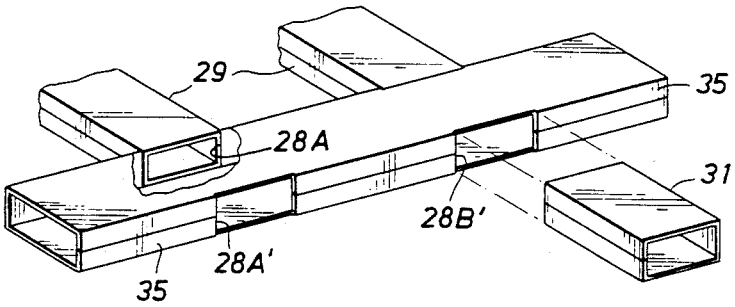
FIG. 5
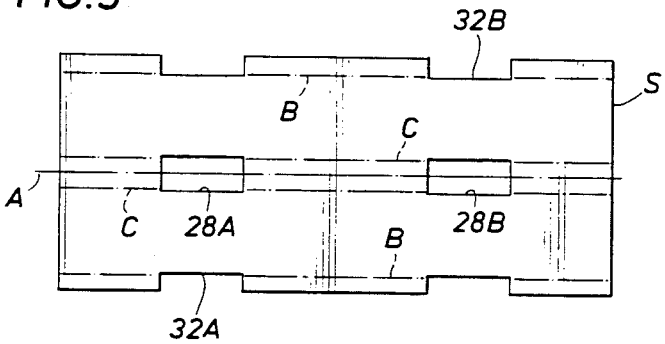
FIG. 6
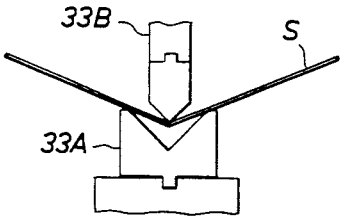
FIG. 7
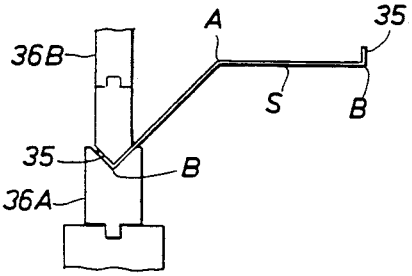
FIG. 8
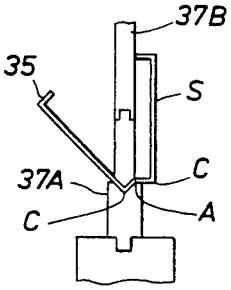
FIG. 9
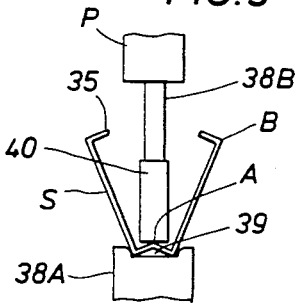
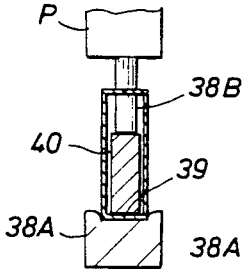
FIG. 11
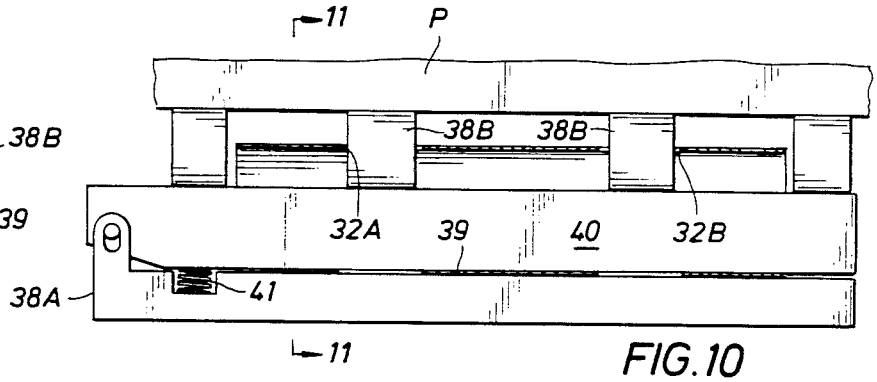
FIG. 10

METHOD OF FORMING RECTANGULAR METAL TUBES

This invention relates in general to a method of and apparatus for use in forming a relatively heavy, rectangular metal tube, and, more particularly, such a tube which has an opening in at least one side thereof.

Tubes of this type are useful, for example, in the construction of relatively large, self supporting structures such as a rack having a base with openings in its sides to receive the tines of fork lift trucks, whereby the rack may be raised, lowered and moved from place to place. Commercially available tubes of this type are relatively expensive, and then, of course, would have to have the side openings cut therein. Furthermore, conventional equipment for manufacturing such rectangular metal tubes requires considerable capital investment and skilled labor to operate.

It is therefore the primary object of this invention to provide less expensive methods of and apparatus for use in forming rectangular metal tubes of this type.

A more particular object is to provide such methods and apparatus which enable the tubes to be formed from a flat sheet of metal by bending it into the desired shape with the use of relatively inexpensive equipment requiring only unskilled labor to operate.

These and other objects are accomplished, in accordance with the illustrated and preferred embodiments of the invention, by a method of forming the tube in which slots are cut in the opposite longitudinal side edges of a flat metal sheet in generally lateral alignment with one another and of such size and shape as to form the opening when arranged opposite one another, and the sheet is bent into a shape having inwardly turned flanges along its longitudinal edges. The bent sheet is arranged with a longitudinally extending mid portion thereof intermediate a longitudinally extending die and one face of an elongate punch and with its slots on opposite lateral sides of a ram on the opposite face of the punch which is of a size to fit within the opening. More particularly, the mid portion of the sheet is of such shape or the supporting surface of the die is of such construction that when the ram is moved in a direction to force the one face of the punch against the mid portion of the sheet, the sides of the sheet and the longitudinal edges of its flanges are swung inwardly toward one another and the slots move around the ram to form the opening in the tube.

In one embodiment of the invention, the sheet is further bent into a shape in which the mid portion is an inverted "V" which forms a "W" with the sides of the sheet and which is flattened against the die as the one face of the punch is formed thereagainst. In another embodiment, the mid portion of the sheet is substantially flat and arranged opposite a longitudinal depression in the supporting surface of the die of a size to receive the punch and sheet beneath it so that the sheet is bent along opposite sides of its mid-portion as it is forced into the depression.

The die, punch and ram form parts of apparatus in which, in accordance with the first described embodiment of the invention, the die has a support surface which is substantially flat to permit the inverted "V" shaped midportion of the sheet to be flattened thereagainst, and, in accordance with the other embodiment of the invention, the die has an outer body in which the longitudinal depression is formed, an inner body movable within the depression between positions toward and away from the open end of the depression, and means yieldably urging the inner body toward the open end of the depression. In both embodiments of the apparatus, the punch is mounted on the die to permit its one face to be moved toward and away from the die, whereby the bent sheet may be first installed between the punch and die and the formed tube then removed from between them.

In the drawings, wherein like reference characters are used throughout to indicate like parts:

FIG. 3 is a top plan view of the rack and broken away in part to show the interconnection of the ends of tube sections with side openings in a tube formed in accordance with this invention;

FIG. 4 is a perspective view of a portion of the base of the rack including a tube formed in accordance with the present invention and having its side openings connected to the open ends of the perpendicularly arranged metal tube sections;

FIG. 5 is a plan view of a flat sheet of metal from which the tube is to be formed and having slots formed in its longitudinal edges on opposite sides of a central opening in a longitudinally extending intermediate portion thereof;

FIGS. 6 to 8 illustrate the steps of bending the sheet in accordance with the first described embodiment of the invention, FIG. 6 being an end view of the metal sheet supported upon a first die and beneath a first punch which has been lowered to engage the sheet intermediate its longitudinal side edges in order to initially bend it into a "V" shape, FIG. 7 being another end view of the metal sheet following bending of the sheet into a "V" shape, and supported on a second die beneath a second punch which has been lowered to form a flange along one longitudinally extending edge opposite a previously formed flange along its other longitudinal edge, and FIG. 8 being still another end view of the sheet supported on a third die beneath a third punch which has been lowered to bend it on one side of the apex of its "V" shape, and opposite a previously formed bend on the other side of the apex of its "V" shape to form a longitudinally extending, inverted "V" shaped mid-portion, and thus, with the sides of the strip, a "W" shape;

FIG. 9 is another end view of the bent metal sheet and apparatus constructed in accordance with the first described embodiment wherein the inverted "V" shaped portion of the "W" shaped sheet is supported on a die beneath the lower face of a longitudinally extending punch which is beneath a ram on its upper face;

FIG. 10 is a side view of the sheet and apparatus with rams lowered to force the punch downwardly to flatten the inverted "V" shaped portion of the metal sheet and thus swing its edges and the flanges toward one another on opposite sides of the rams;

FIG. 11 is a side view of the sheet and press following formation of the tube, as seen along broken lines 11—11 of FIG. 10; and FIGS. 12 to 14 illustrate steps in the formation of a tube in accordance with the second described embodiment, FIG. 12 being an end view of a sheet having inwardly turned flanges along its longitudinal edges and with its midportion supported above a longitudinal depression in the outer body of a die and beneath a punch at the lower end of a ram of the apparatus, FIG. 13 being another end view in which the ram has been lowered to force the punch and sides of the sheet into the depression to swing the opposite sides of the sheet inwardly to cause slots in the flanges thereof to move around opposite sides of the ram, and FIG. 14 being another end view in which an inner body in the depression of the outer body has been spring pressed upwardly to assist in removing the tube from the apparatus.

Figure 1:
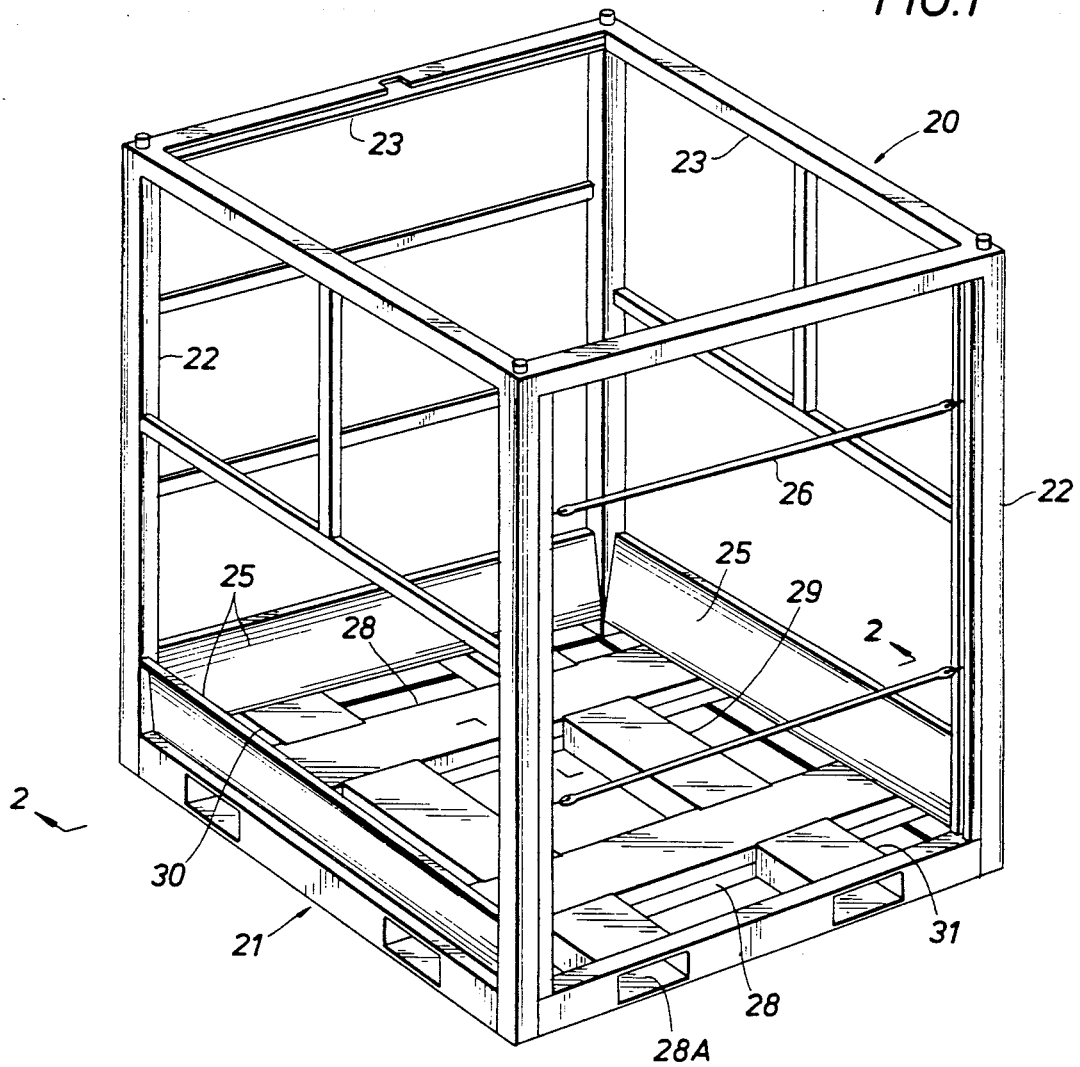
FIG. 1 is a perspective view of a rack including a base formed of perpendicularly arranged, interconnecting rows of open ended, rectangular metal tubes including some having openings formed in its sides in accordance with the present invention.
Figure 2:
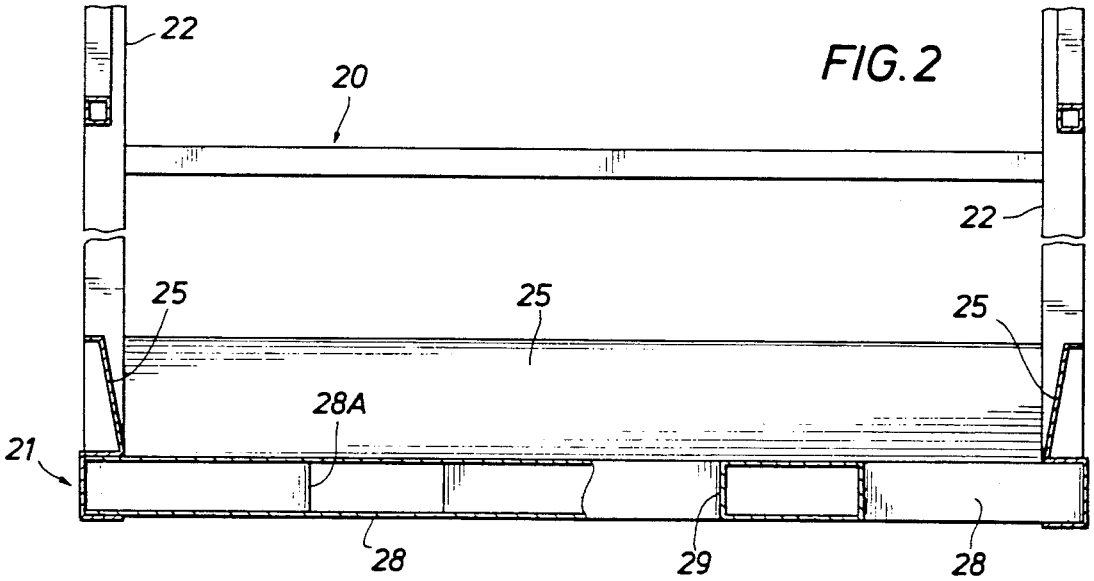
FIG. 2 is an enlarged vertical sectional view of the rack, as seen along broken lines 2—2 of FIG. 1.

With reference now to the details of the above described drawings, the rack which is shown in FIG. 1, and indicated in its entirety by reference character 20, includes a base 21 adapted to be supported on a horizontal surface and posts 22 extending upwardly from each corner of the base. Cross members 23 extend between and connect the upper ends of the post 22 to form a substantially rectangular open framework, with the inner sides of certain of the cross members 23 being grooved to receive the ends of bars adapted to extend between them and from which parts, such as automobile door panels, may be suspended. Walls 25 are secured between the lower ends of the posts on three sides of the base to confine the lower ends of certain of the panels.

The base 21 includes channels 27 which are connected to the lower ends of the posts on all four sides, and a pair of spaced metal tubes 28 which extend between one pair of side channels, and a pair of spaced rows of tube sections 29, 30 and 31 connected to opposite sides of the tube 28 and extending between them and the other pair of channels 27. Each of the metal tubes 28, which is formed in accordance with the present invention, has openings 28A and 28B on its inner side connected in alignment with the adjacent open ends of the intermediate tube sections 29, and openings 28A' and 28B' on its outer side aligned with openings 28A and 28B and connected in alignment with the adjacent open ends of the outer tube sections 30 and 31. Thus, the outer open ends of the tubes 28 and the outer open ends of the tube sections 30 and 31 provide a pair of through openings on each side of the base positioned to receive the tines of a forklift truck. It should be understood, however, that although the tubes 28 have particular utility in this sort of structure, each may have use in another structure or environment requiring one or more aligned openings in its opposite sides, or in only one side of the tube.

The rectangular tube sections 29, 30, and 31 may be formed from bent flat sheets welded along their edges or cut from conventional rectangular metal tubing. As previously described, however, each of the metal tubes 28 is formed from a flat sheet of metal indicated in its entirety by reference character S and shown in FIG. 5 to have the first pair of openings 28A and 28B formed in a mid-portion thereof intermediate its longitudinal edges, and slots 32A and 32B formed in the longitudinal edges in general alignment with one another and with the openings 28A and 28B. Thus, upon bending of the metal sheet in the manner to be described, the slots 32A and 32B are disposed opposite one another to form the second pair of openings 28A' and 28B', respectively, in alignment with and on the sides of the tube opposite the first pair.

The letters A, B, and C in FIG. 5 indicate imaginary lines along which the sheet is bent during the successive steps of the first embodiment of the method illustrated in FIGS. 6 and 11 and described below. As shown, the bend line A is midway between the opposite longitudinal edges of the sheet, and thus midway of the opposite sides of the first part of openings 28A and 28B, the bend lines B are substantially aligned with the inner edges of slots 32A and 32B which are to form the second pair of openings 28A' and 28B', and the bend lines c are substantially aligned with the side edges of the first pair of openings 28A and 28B.

The flat sheet is first arranged on a die 33A having a concave, "V" shaped upper side and with the bend line A disposed directly above the apex of the "V". More particularly, the die is arranged beneath a punch 32B having a sharp edge at its lower end adapted to be moved downwardly onto the bend line A and, upon continued lowering, to bend the sheet S into a "V" shape about the bend line A.

Upon raising of the punch 33B, the metal sheet S is removed from die 33A and inverted to permit flanges 35 to be formed along its opposite longitudinal edges. For this purpose, the sides of the sheet on each side of the bend line A are each supported on a die 36A having an upper "V" shaped surface disposed beneath the lower "V" shaped end of a punch 36B, as shown in FIG. 7. More particularly, each side of the sheet on each opposite side of bend line A is disposed with the imaginary line B in alignment with the "V" shaped surface and the lower "V" shaped end of the punch 36B, so that, when the punch is lowered, as shown in FIG. 7, it forms a flange 35 on the outer end of each side.

When both flanges have thus been formed, the metal sheet is moved into a supported position upon another die 37A having a "V" shaped upper end, and beneath the "V" shaped lower end of a punch 37B above the die. As shown in FIG. 8, lowering of the punch 37B will bend each longitudinally extending side portion of the sheet along the bend line C and thus into an inverted "V" shape, which, together with the longitudinally extending sides of the sheet, form a substantial "W" shape, as shown in FIG. 8.

Of course, the sheet may be bent into its "W" shape by other means, but, in any case, upon raising of the punch 37B, it is moved onto the die 38A of the apparatus P shown in FIGS. 9 to 11 to include rams 38B vertically reciprocable above the upper side of a die 38A. The upper side of the die has a shallow recess 39 adapted to closely receive the inverted "V" shaped portion of the "W" shaped sheet, and, thus, as shown in FIG. 9, maintain the bend line A of the metal sheet beneath the lower end of a punch 40 and with the sides of the bent sheet symmetrically located with respect to the die and punch.

More particularly, the elongate punch 40 is supported on the die 38A generally above the recess 39 and thus above the inverted "V" shaped portion of the "W" shaped metal sheet, when the latter is supported in the recess 39. As shown, the punch is pivotally connected at one end to the die, and is urged upwardly by means of springs 41 to permit the "W" shaped bent metal strip to be moved longitudinally between the lower face of the punch and the recess 39 on the upper side of the die 38A, as shown in FIG. 9, to a position in which the slots 32A and 32B therein are on opposite sides of the rams 38B, as shown in FIG. 10.

With the bent sheet so positioned, the rams 38B may be moved downwardly to in turn lower the lower face of the punch 40 into engagement with the apex of the inverted "V" shaped portion of the sheet at the bend line A, and, upon continued downward movement, flatten the inverted "V" shaped portion. This causes the opposite sides of the metal sheet to swing inwardly toward one another, and, since the slots 32A and 32B are laterally opposite and of a size to move around the rams 38B, the longitudinal inner edges of the flanges 35 are free to move into engagement with one another, as shown in FIG. 11.

At this time, the rams may be raised, and the punch swung upwardly to permit the tube to be moved longitudinally from between it and the die 38A. When so removed, the rectangular tube 28 may be completed by welding of its adjacent longitudinal edges to one another.

In accordance with the alternative embodiment of the invention illustrated in FIGS. 12 to 14, a flat metal sheet S' has been initially bent into a shape having flanges 41 turned inwardly along longitudinal edges and along a bend line substantially aligned with the inner sides of slots 42 formed in the edges. As in the case of the sheet S shown in FIG. 5, these slots are formed generally laterally opposite one another and are of a size and shape to form an opening in a side of the tube to be formed. Also, the flanges may be formed along the opposite longitudinal edges of the flat sheet in much the same manner illustrated in connection with FIG. 7. Obviously, there may be one or more longitudinally sets of slots formed along the longitudinal edges of the sheet S', depending upon the number of openings to be provided in the side of the resulting tube. In the illustrated case, however, the sheet S' does not have another set of openings formed in the longitudinal mid portion thereof.

As shown in FIG. 12, the sheet S' is initially supported with its longitudinally extending mid portion above a longitudinal depression 43 of an outer body 44 of a die of the apparatus to be used in bending the sheet S' into a tube in accordance with this alternative embodiment of the invention. As shown, the die also includes an inner body 45 which is movable vertically within the depression 43 and yieldably urged by a coil spring 46 to an upper position near the upper open end of the depression.

The depression is of a width to receive the lower end of an elongate punch 47 having a lower face above the mid portion of the sheet S' and opposite sides of the sheet as they are bent upwardly along opposite sides of the punch. Thus, as the punch is moved downwardly, as illustrated in FIG. 13, it forces the mid portion of the sheet into the upper end of the depression, whereby the upper side edges of the depression force the sides of the sheet at each opposite side of the mid portion to swing upwardly and inwardly toward one another, the sheets thus fitting closely between the opposite sides of the punch and inner sides of the depression, as shown in FIG. 13. Thus, upon continued lowering of the punch, the opposite longitudinal edges of the sheet are caused to swing inwardly into engagement with one another to form the tube.

As in the case of the press used in connection with the first described embodiment of the invention, the apparatus of FIGS. 12 to 14 also includes rams 48 having lower ends above the upper face of the punch. When two or more openings are to be formed in the side of the tubing, a similar number of rams are provided in longitudinally spaced relation, corresponding to the spacing of the slots forming the openings, whereby the sheet S' may be initially moved into a position between the punch and die in which the slots are laterally opposite the rams 48. Thus, as in the prior described embodiment of the invention, the slots are caused to move over the sides of the rams to permit the longitudinal edges to engage, as shown in FIG. 13. During this downward movement of the punch and the bent portions of the sheet on its opposite sides, the inner body 45 is forced downwardly against the spring 46. When the tube has thus been formed, the rams 48 may be raised to permit the spring 46 to expand and thus raise the inner body 45 to lift the tube to a position in which it may be removed from the apparatus. As in the case of the apparatus of the previously described invention, the punch 47 may be so mounted on the outer body of the die to permit it to be raised or lowered to facilitate insertion of the bent sheet S' and removal of the formed tube.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In a method of forming a rectangular metal tube having an opening in a side thereof, comprising the steps of cutting slots in opposite longitudinal side edges of a metal sheet which are generally laterally aligned with one another and of such size and shape as to form the opening when arranged opposite one another, bending the sheet into a shape having longitudinally extending, inwardly turned flanges, arranging the sheet with a longitudinally extending mid portion thereof intermediate a longitudinally extending die and one face of an elongate punch and with its slots on opposite lateral sides of a ram on the opposite face of the punch which is of a size to fit within the opening, and moving the ram in a direction to force the one face of the punch against the mid portion of the sheet and thereby cause the sides of the sheet and the longitudinal edges of its flanges to swing inwardly toward one another and the slots to move around the rams to form the opening in the tube.

2. In a method of the character defined in claim 1, including the steps of further bending the sheet into a shape in which the mid portion is an inverted "V" which forms the sheet into a "W" with the sides of the sheet which is flattened against the die as the one face of the punch is forced thereagainst.

3. In a method of the character defined in claim 1, wherein the mid-portion of the sheet prior to its arrangement intermediate the dye and punch is substantially flat and arranged opposite a depression in the die of a size to receive the punch whereby the sheet is bent along opposite sides of the mid-portion as the face of the punch is forced against the mid portion to move said mid-portion into the depression.

4. In a method of the character defined in claim 1, including the step of cutting another opening in the mid-portion of the sheet generally laterally intermediate the slots so as to be generally aligned with the first opening upon formation of the tube.

* * * * *